United States Patent [19]

Corsetti

[11] Patent Number: 4,691,395

[45] Date of Patent: Sep. 8, 1987

[54] WATERBED FRAMES

[76] Inventor: John A. Corsetti, 833 SW. Bayshore Blvd., Port St. Lucie, Fla. 33452

[21] Appl. No.: 941,071

[22] Filed: Dec. 12, 1986

[51] Int. Cl.[4] ..... A47C 19/00; A47C 21/08

[52] U.S. Cl. ..... 5/400; 5/428; 5/451

[58] Field of Search ..... 5/400, 401, 200 R, 201, 5/451, 452, 430, 425, 428, 429

[56] References Cited

U.S. PATENT DOCUMENTS 2,601,015 6/1952 Gruber ..... 5/430

4,413,367 11/1983 Miller et al. ..... 5/451

*Primary Examiner*—Alexander Grosz

*Attorney, Agent, or Firm*—Carroll F. Palmer

[57] ABSTRACT

Waterbed frames for supporting and confining a bladder-type mattress having a head panel, a foot panel and a pair of side panels are improved to assist persons reclining in the bed to get out of the bed by providing at least one side panel with a section that can be lowered relative to the remainder of the panel creating an exit area along the side of the frame within which there is no obstruction against egress above the upper level of the mattress. To leave the bed, the person lowers the side panel section and passes through the resulting opened exit area.

3 Claims, 7 Drawing Figures

WATERBED FRAMES

BACKGROUND OF THE INVENTION

1. Field of the Invention

This invention relates to waterbeds. More particularly, it concerns improvements in the construction of waterbed frames to assist persons reclining on them to get out of them more easily.

2. Description of the Prior Art

Waterbeds are a relatively new class of beds in terms of the history of bed construction and use. This is partially due to the technological advances made in the materials of construction and design for the mattress bladders which form such an important part of such beds.

One problem that existed early on with waterbeds was water-flooding that occurred when a mattress bladder might be punctured thereby spilling the the entire water contents of the mattress into the surrounding room. This problem has to a major extent been solved by use of containment pans and improvements in the mattress bladders, both as to design and material of construction.

Another problem in connection with waterbeds which has not, prior to the present invention, been satisfactorily solved concerns getting out of the beds. One of the attractions of waterbeds is the "give" which their mattresses provide making it possible for them to conform precisely to the contour of the body of a person lying on the bed. However, this "give" creates a problem when the person in the bed wants to get out of it. Thus, as the person tries to get out, the area of the mattress supporting the person becomes greatly reduced and that area is forced almost to the bottom of the mattress so that the person, rather than simply sliding off the edge of the bed, as in the case of a conventional "hard" mattress, must climb up over a ledge which is substantial in height. This invention addresses this known problem in waterbeds and provides a solution.

In the construction of waterbeds, it is known to use frames in which the side panels may be lowered, for example, to assist in the handling sheets and other bed coverings (see U.S. Pat. No. 4,413,367). In a broader sense, moveable side panels or frame members have be used in the construction of various types of beds (see U.S. Pat. Nos. 3,585,660 and 3,800,342). The present invention uses moveable frame parts in a unique way to help solve the waterbed exiting problem.

OBJECTS

A principal object of the invention is new improvements in waterbeds.

Further objects include the provision of:

1. New improvements in frames for waterbeds.
2. Improved waterbed frame panels that assist persons reclining in the bed to get out of the bed.
3. New forms of waterbeds which permit a person reclining therein to get out of the bed by sliding off the side of the mattress in the manner of exiting a bed in the conventional manner rather than needing to climb up a substantial distance over the bed frame.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of improvements in waterbed frames for supporting and confining a bladder-type mattress which have a horizontal mattress support member, a head panel, a foot panel and a pair of side panels that assists a person reclining in the bed to exit therefrom.

The improvement consists of providing in at least one of the side panels of the bed frame a moveable section, which is substantially shorter in length than the total length of the side panel, that can be lowered relative to the remainder of the panel to provide an exit area along the side of the frame within which there is no obstruction against egress above the upper level of the mattress.

Additionally, the new waterbeds include on the mattress support member an arcuate web having a longitudinal side contiguous with the moveable, side panel section that slopes upwardly from the support member toward the moveable section thereby to more strictly confine the mattress in the region of the mattress adjacent the moveable section then over the remainder of the support member.

In preferred embodiments of the new waterbed frames, the moveable section is carried on the remainder of the panel upon vertical slide members to move relative to the remainder in the longitudinal plane of the panel. Also, the arcuate web on the support member of the bed is semi-elliptical in shape.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
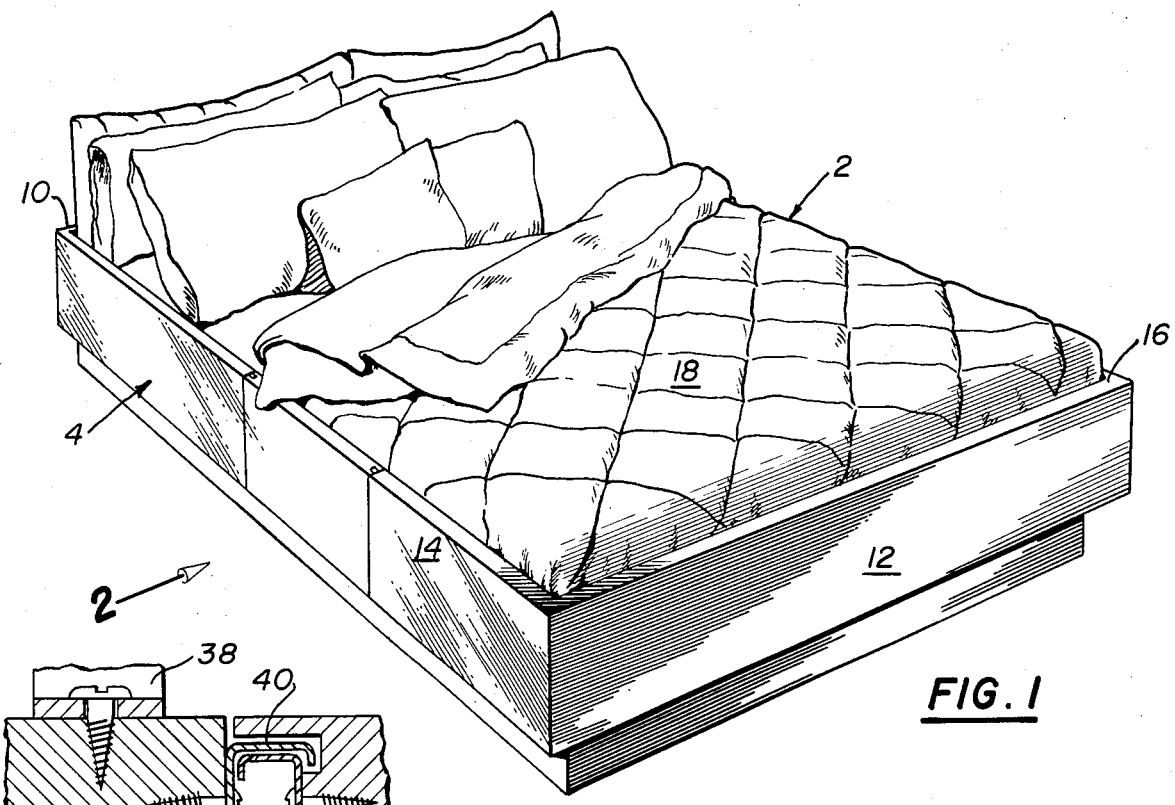
FIG. 1 is a perspective view of a waterbed constructed in accordance with the invention.
Figure 3:
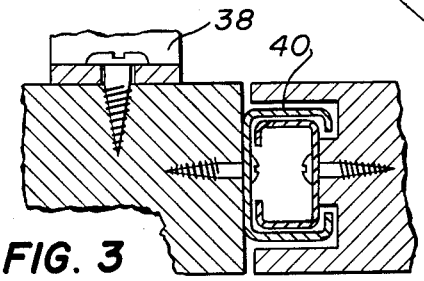
FIG. 3 is a sectional view taken on the line III—III of FIG. 2.

Referring in detail to the drawings, in which identical parts are identically marked, the invention provides an improved waterbed 2 with a frame 4 for supporting and confining a bladder-type mattress 6 and having a horizontal mattress support member 8, a head panel 10, a foot panel 12 and a pair of side panels 14 & 16. The waterbed 2 is shown with bed coverings 18.

The side panel 14 has a section 20 thereof that can be lowered relative to the remainder 22 of the panel to provide an exit area 24 along the side of the frame 4 within which there is no obstruction against egress above the upper level 26 of the mattress 6.

Figure 5:
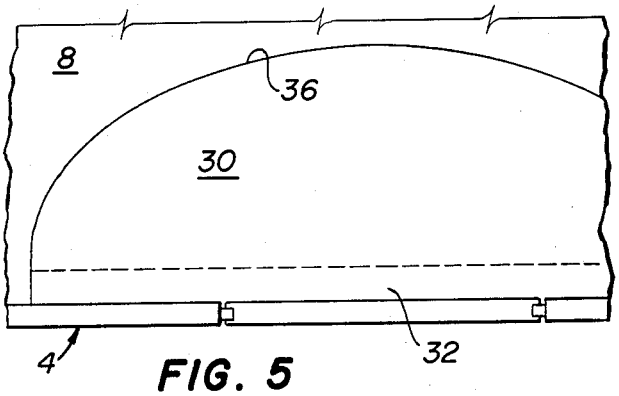
FIG. 5 is a fragmentary, plan view of the area of the waterbed involved with FIG. 2 shown with the mattress bladder removed from its support member.
Figure 6:
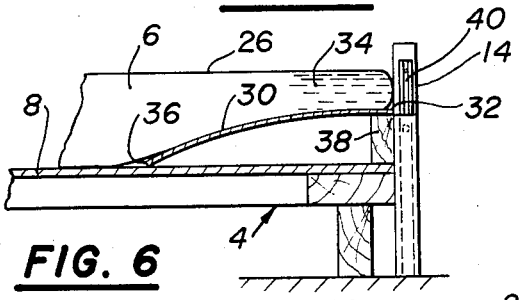
FIG. 6 is a sectional view taken on the line VI—VI of FIG. 4.

An arcuate web 30 having a longitudinal side 32 contiguous with the section 20 slopes upwardly from the support member 8 toward the section 20 thereby to more strictly confine the mattress 6 in the region 34 thereof adjacent the section 20 then over the remainder of the support member 8. As shown in FIG. 5, the web 30 is preferably semi-elliptical in shape.

The arcuate edge 36 of the web 30 rests on the mattress support 8 while the longitudinal side 32 is elevated by the spacer member 38.

The section 20 is carried on the remainder 22 of the panel 14 upon vertical slide members 40 to move relative to the remainder in the longitudinal plane of the panel 14.

Figure 2:
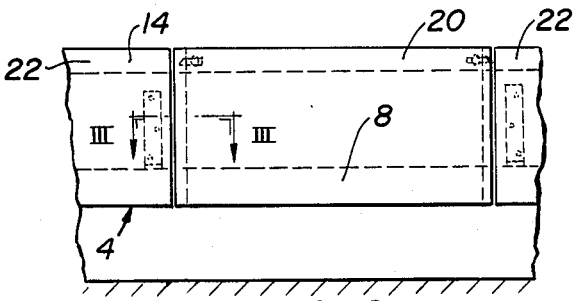
FIG. 2 is a fragmental, lateral view of a portion of a side panel of the waterbed of FIG. 1.

A pair of latches 42 are provided on the inside of the moveable section 20 to hold it in the elevated position (see FIG. 2) and permit it to be moved to the lowered position (see FIG. 4) when the person (not shown) reclining in the waterbed 2 wishes to get out of it.

Figure 4:
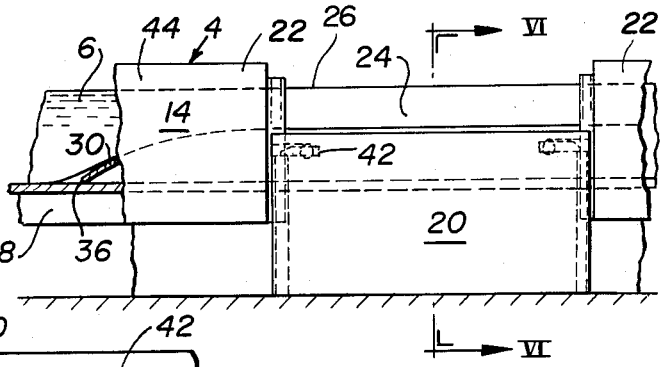
FIG. 4 is a fragmentary, lateral view similar to FIG. 2, but with a moveable portion of the side panel in a lowered position.
Figure 7:
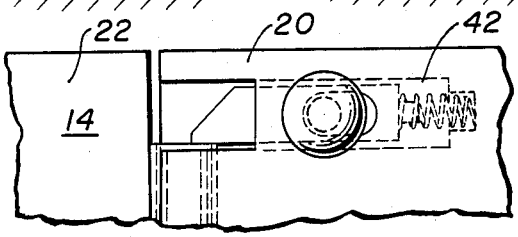
FIG. 7 is a fragmentary, enlarged, sectional view of a latch member for the moveable portion of the side panel shown in FIG. 2.

As seen in FIG. 4, with the section 20 in the lowered position, there is no side obstruction extending above the mattress area 34 within the area defined by the section 20. Hence, in getting out of the improved waterbed 2, a user needs only to slide sideways off the compressed portion 34 of the mattress 6, in contrast to exiting a conventional waterbed where the user would be required to lift his body up over the top edge a side panel a distance corresponding approximately to the distance between the mattress support 8 and the top edge 44 of the side panel 14. With older persons or even overweight younger persons, such lifting routine with conventional waterbeds can be a troublesome chore.

The embodiments of the invention in which an exclusive property or privilege is claimed are defined as follows:

1. In a waterbed frame for supporting and confining a bladder-type mattress having a horizontal mattress support member, a head panel, a foot panel and a pair of side panels, the improvement that assists a person reclining in the bed to exit therefrom which comprises:

at least one of said side panels having a section thereof that can be lowered relative to the remainder of said panel to provide an exit area along the side of said frame within which there is no obstruction against egress above the upper level of said mattress and an arcuate web having a longitudinal side contiguous with said section that slopes upwardly from said support member toward said section thereby to more strictly confine said mattress in the region thereof adjacent said section then over the remainder of said support member.

2. A waterbed frame according to claim 1 wherein said section is carried on said remainder of said panel upon vertical slide members to move relative to said remainder in the longitudinal plane of said panel.

3. A waterbed frame according to claim 2 wherein said arcuate web is semi-elliptical in shape.

* * * * *